United States Patent [19]

Dahlmann

[11] Patent Number: 4,997,345

[45] Date of Patent: Mar. 5, 1991

[54] PRESSURE RELIEF VALVE FOR A FUEL INJECTION PUMP OF AN INTERNAL COMBUSTION ENGINE

[75] Inventor: Gerd-Uwe Dahlmann, Brunswick, Fed. Rep. of Germany

[73] Assignee: Volkswagen AG, Wolfsburg, Fed. Rep. of Germany

[21] Appl. No.: 403,126

[22] Filed: Sep. 5, 1989

[30] Foreign Application Priority Data

Sep. 2, 1988 [DE] Fed. Rep. of Germany ..... 3829822

[51] Int. Cl.[5] ..... F02M 39/00

[52] U.S. Cl. ..... 417/282; 123/458; 123/506; 137/110

[58] Field of Search ..... 417/282; 123/458, 506; 137/110; 251/129.03, 129.05, 129.15

[56] References Cited

U.S. PATENT DOCUMENTS

| | | | |
|---|---|---|---|
| 3,724,485 | 4/1973 | Cox et al. | 137/110 |
| 4,394,856 | 7/1983 | Smith et al. | 123/506 |
| 4,597,369 | 7/1986 | Yasuhara | 123/458 |
| 4,753,212 | 6/1988 | Miyaki et al. | 123/506 |
| 4,793,314 | 12/1988 | Yoshinaga et al. | 123/506 |

FOREIGN PATENT DOCUMENTS 3511492 10/1986 Fed. Rep. of Germany .

*Primary Examiner*—A. Michael Chambers

*Attorney, Agent, or Firm*—Brumbaugh, Graves, Donohye & Raymond

[57] ABSTRACT

A pressure relief valve for a fuel injection pump of an internal combustion engine contains a valve-closing element capable of moving, by means of an electromagnetic actuation device, between a closed position, in which it rests on a valve seat and closes a pressure relief connection between a pressure chamber and a pressure relief outlet, and an open position where the valve-closing element and a sleeve servo slide gate positioned thereon, separate from a valve seat to create a pressure relief opening for relief of fuel pressure. When the fuel pressure is sufficiently high, the servo slide gate separates from its seat, against the action of a spring, by an additional amount to expose an additional pressure relief connection on the valve-closing element for relief of fuel pressure. Despite only limited motion by the valve-closing element, the pressure relief valve facilitates, with extreme precision, control over the start and the end of fuel injection during the actuation stroke of a coordinated fuel pump.

4 Claims, 2 Drawing Sheets

21
22
12
7
9
8
13
10
18
15
20
19
11
6
14
18

12
7
9
8
13
10
17
15
18
20
22
21
19
11
6
14
10
16
18

21
12
7
9
8
13
18
15
20
22
19
11
6
14
10
18

12
7
9
8
13
18
15
20
22
19
21
11
6
14
10
18

12
7
9
8
13
15
18
22
20
19
21
11
6
14
10
18

PRESSURE RELIEF VALVE FOR A FUEL INJECTION PUMP OF AN INTERNAL COMBUSTION ENGINE

BACKGROUND OF THE INVENTION

This invention relates to pressure relief valves for fuel injection pumps of internal combustion engines and, more particularly, to a new and improved pressure relief valve of this type.

The use of an electromagnetic actuation device to control fuel pressure relief in a fuel injection device is described in German Offenlegungsschrift No. 35 11 492. As described therein, a pressure relief valve has an electromagnetic actuation device capable of positioning a valve-closing element into an open position which connects a fuel injection pressure chamber with a pressure relief outlet. That pressure relief valve includes a compression spring to restore the valve-closing element into a position in which the opening between the fuel pressure chamber and the fuel pressure relief outlet is closed. In order to minimize the force exerted by the actuation device in moving the valve-closing element into its open position in that valve, and also to minimize the movement necessary to restore the valve-closing element to its closed position, the valve seat is shaped so that, in the closed position, the valve-closing element has no surfaces which are subject to fuel pressure in the axial direction. However, immediately after the valve-closing element is separated from its valve seat, surfaces of the valve-closing element are exposed to fuel pressure in the axial direction so that the fuel pressure in the pressure chamber which is connected with a work chamber of the fuel pump is added to the electromagnetic force of the actuation device.

In a pressure relief valve of that type, a piezoelectric actuation device may also be used in place of the electromagnetic actuation device. Because of the reduction in fuel pressure in the valve pressure chamber, which is connected to the fuel injection valves of the internal combustion engine, a pressure relief valve of that type offers the advantageous possibility of ending the injection process before the work stroke of the fuel injection pump piston is complete. The closing of the pressure relief valve, that is, the movement of the valve-closing element into its closed position, is accomplished by a coordinated spring when the actuation device is de-energized after the end of the work stroke of the fuel injection pump piston, that is, after the end of the pump delivery stroke.

SUMMARY OF THE INVENTION

Accordingly, it is an object of the present invention to provide an improved pressure relief valve for a fuel injection pump of an internal combustion engine.

It is another object of the invention to provide a pressure relief valve capable of functioning at higher operating speeds with a relatively simple construction.

These and other objects of the invention are attained by providing a pressure relief valve having a servo slide gate positioned on a valve-closing element which is capable of sufficient axial movement to expose an additional pressure relief opening. The additional pressure relief opening is exposed when an electromagnetic actuation device moves the valve-closing element out of its closed position and causes surfaces of both the valve-closing element and the servo slide gate to be subjected to axial forces resulting from fuel pressure in a pressure chamber, thereby causing the slide gate to expose the additional pressure relief opening when, and only to the extent that, the pressure in the pressure chamber is sufficient to move the slide gate to expose the additional pressure relief opening. The fuel pressure necessary to move the slide gate to expose the additional pressure relief opening is determined by the size of the surface area which is subject to axial pressure from the fuel pressure chamber and by the design of the return spring.

Beside interrupting the connections between the pressure chamber and the pressure relief outlet so that the start of the related fuel injection cycle is defined, the pressure relief valve according to the present invention controls two fuel outlets. The first outlet is a small pressure relief section which is exposed simply by the lifting of the valve-closing element from its valve seat so that the servo slide gate is retained on a stop device on the valve-closing element and has essentially no influence on the injection cycle. The second outlet is a large pressure relief section which is exposed by the fuel-pressure-dependent axial motion of the servo slide gate and consists of at least one cross-channel in the valve-closing element. This latter configuration, in which both the small and the large pressure relief sections are opened, determines when the related fuel injection cycle ends and is dependent on the fuel pressure in the pressure chamber. Because the valve-closing element can have a relatively small size, it operates with short strokes, thereby allowing the electrical actuation device to control the position of the valve-closing element very rapidly.

BRIEF DESCRIPTION OF THE DRAWINGS

Further objects and advantages of the invention will be apparent from a reading of the following description in conjunction with the accompanying drawings in which.

The same reference numbers are used in all figures. Arrows indicate the direction of fuel flow in the various figures.

DESCRIPTION OF PREFERRED EMBODIMENTS

Figure 1:
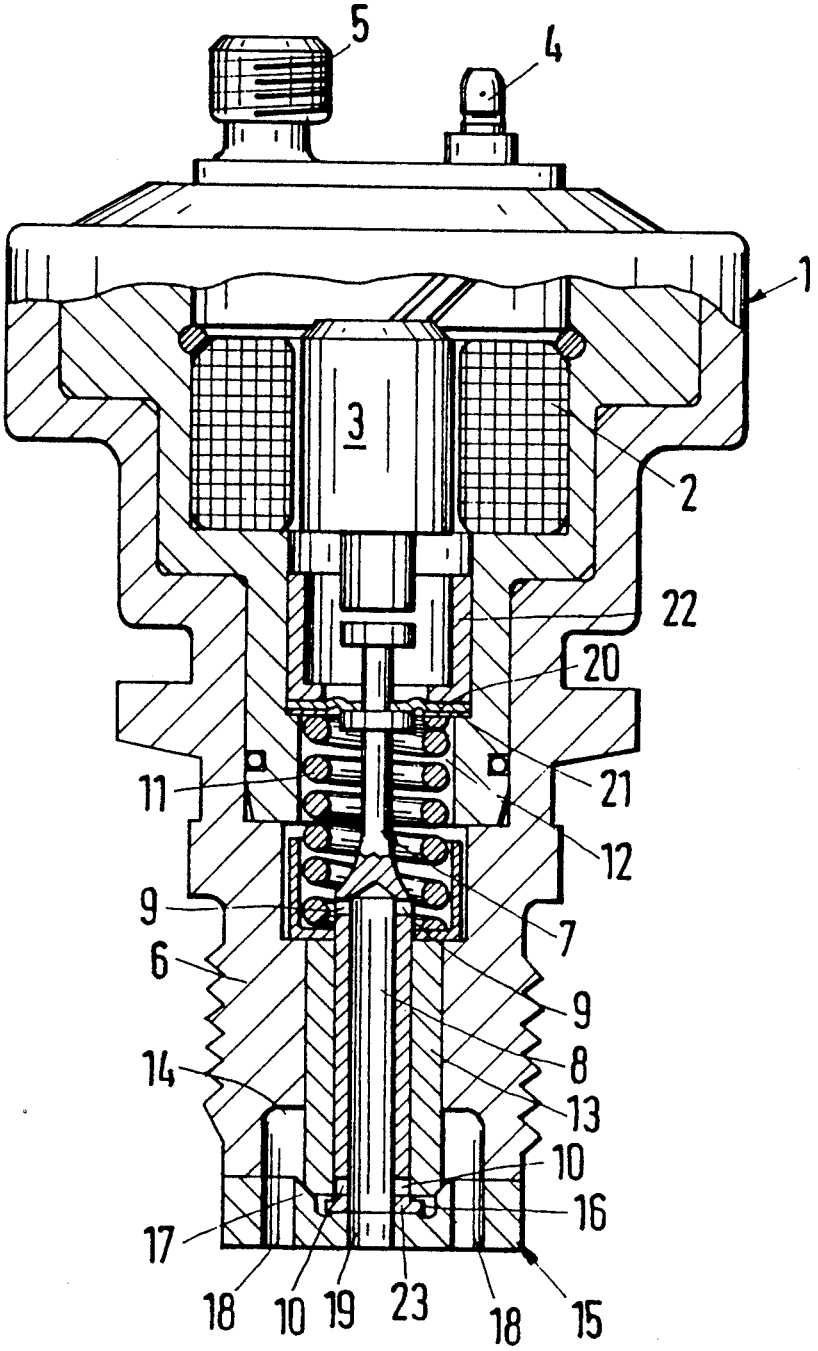
FIG. 1 is a schematic side view illustrating a representative embodiment of a pressure relief valve according to the invention.

In the typical embodiment of the invention shown in FIG. 1, a pressure relief valve includes an electromagnetic actuation device 1 with an electromagnet coil 2 and an armature 3. Shown above the electromagnetic device and outside the body of the pressure relief valve are an electrical terminal 4 for the electromagnet and a fuel inlet 5.

A valve body 6, which can be screwed into a fuel pump (not shown), contains the essential components of the valve, namely: a valve-closing element 7 with an axial channel 8 and top and bottom cross-channels 9 and 10; a servo slide 13 arranged to move against the force of a compression spring 11 disposed in a compression spring chamber 12; a fuel pressure chamber 14 located in the region at the end of the valve-closing element 7 that faces away from the actuation device 1; and a closing plate 15 which has valve seats 16 and 17 for sealing the valve-closing element 7 and the servo slide gate 13. The valve-closing element and the servo slide are designed so that, when both of those components are resting on the valve seats 16 and 17, they have no surface areas which are subjected to axial pressure from the fuel pressure in the pressure chamber 14. Both of the components 7 and 13 are thus balanced.

The closing plate 15 is formed with two fuel inlets 18, leading to the pressure chamber 14, and a pressure relief outlet 19, which extends coaxially as an extension of the axial channel 8 in the valve-closing element and which also runs coaxially with respect to the valve seats 16 and 17. The openings 18 and 19 lead to the high-pressure side and low-pressure side, respectively, of the fuel pump. The construction of a fuel pump is known in the art, as illustrated in principle in the above-mentioned German Offenlegungsschrift No. 35 11 492, and, accordingly, it is not described in detail here.

At the end facing the electromagnetic actuation device 1, the valve-closing element 7 extends through a diaphragm 20 which is clamped between a support disc 21 and a diaphragm stop 22 so as to seal off the spring chamber 12. The return spring chamber is always connected to the axial channel so that fuel may be removed from the chamber through at least one of the cross-channels 9 in the valve-closing element 7.

The operation of the pressure relief valve will be described with reference to FIGS. 2 through 6. These figures show different stages of operation of the pressure relief valve and illustrate the functional characteristics of the major internal components of the valve.

Figure 2:
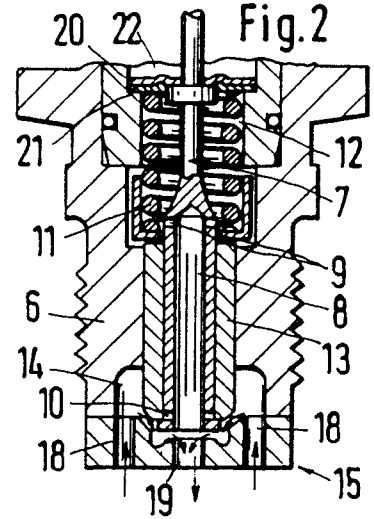

In FIG. 2, the valve-closing element 7 is shown in its open position, so that it releases fuel pressure through the pressure relief outlet 19 as shown by the arrows. The pressure relief opening through which the fuel is being released is limited in size as a result of the position of the servo slide gate 13 on its stop 23, as is illustrated in the figure. In this case, the fuel pressure in the pressure chamber 14 is below the minimum value necessary to move the servo slide gate 13 against the action of the spring 11.

Figure 3:
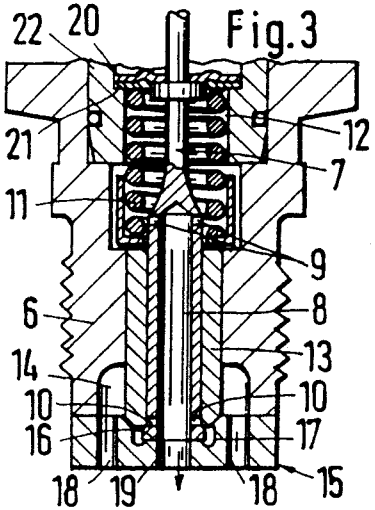

In FIG. 3, as a result of switching off the electromagnetic actuation device 1, the valve-closing element 7 is moved into its closed position so that the valve-closing element rests on its valve seat 16 and closes the pressure relief outlet 19. Thus, the connection between the pressure chamber 14, which reflects the pressure side of the fuel pump, and the pressure relief outlet 19 is closed. Under the action of the spring 11, the servo slide gate 13, which rests on the stop 23 of the valve-closing element 7, follows the movement of the valve-closing element until it comes to rest on its valve seat 17. Any and all connection between the pressure relief outlet 19 and the pressure chamber 14 is thereby interrupted. Consequently, the pressure system is hydraulically closed and the fuel pressure on the fuel injection valves reaches a sufficiently high value to cause the fuel injection valves to open. Thus, the action of the pressure relief valve determines, during the forward stroke of the fuel pump, the start of fuel injection.

Figure 4:
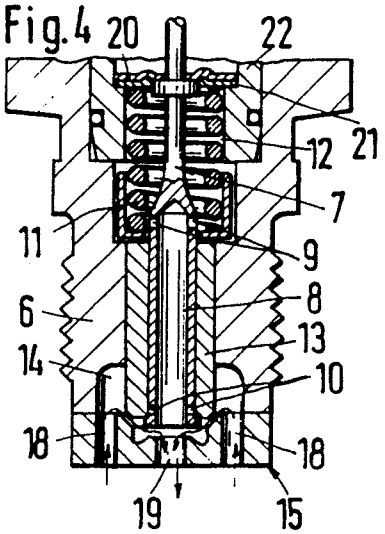
FIG. 2 through FIG. 6 illustrate the pressure relief valve of FIG. 1 in various operating conditions.

In FIG. 4, through energization of the actuation device 1, the valve-closing element 7 is moved out of its closed position, illustrated in FIG. 3, and into its open position, where it has separated from its valve seat 16 and has opened a small pressure relief section. The start of this movement requires only a minimum force by the actuation device because the valve-closing element 7, through the stop 23, lifts the servo slide gate 13 against only the very limited force of the spring 11. As soon as the servo slide gate has separated slightly from its valve seat, the bottom surfaces of the two valve parts 7 and 13, i.e., the surfaces facing toward the closing plate 15, are exposed to the fuel pressure in the pressure chamber 14, which accelerates the valve parts 7 and 13 upwardly.

Figure 5:
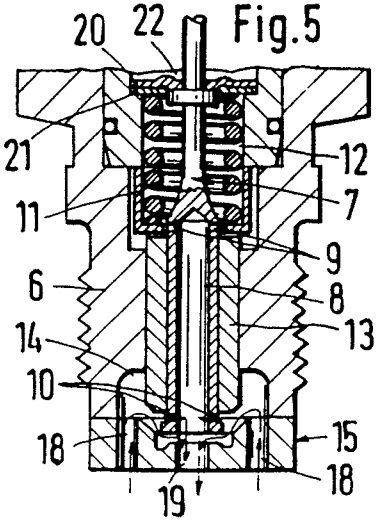

If the fuel pressure in the pressure chamber 14 is sufficient, it causes the servo slide gate 13 to slide upward in relation to the valve-closing element 7, as illustrated in FIG. 5, thereby exposing the bottom cross-channel 10 in the valve-closing element 7. The exposure of the bottom crosschannel provides an additional outflow section, that is, an additional flow connection between the pressure chamber 14 and the pressure relief outlet 19. This results in a rapid pressure interruption in the high-pressure fuel supply system, closing the injection valve and terminating the fuel injection. Since the time period between the start of fuel injection, illustrated in FIG. 3, and the end of fuel injection, illustrated in FIG. 5, determines the quantity of fuel injected, the pressure relief valve according to the present invention facilitates a complete operation of the fuel injection cycle during the forward stroke of the injection pump within broad boundaries. For this purpose, the electromagnetic actuation device is advantageously controlled by a microprocessor according to the various working parameters of the internal combustion engine.

Figure 6:
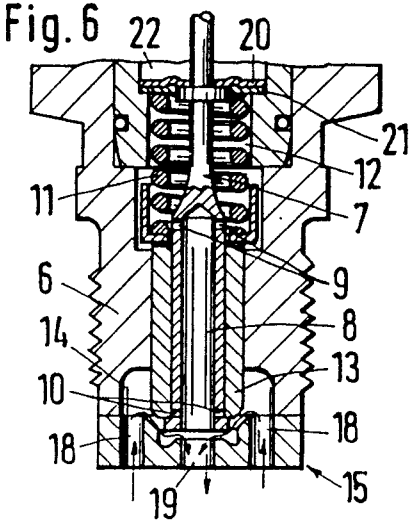

As soon as the fuel pressure in the pressure chamber 14 falls below a minimum figure, the compression spring 11 again moves the servo slide gate 13 downward against its stop 23, so that, as illustrated in FIG. 6, the various components are once again in the starting position.

The present invention, which provides an advantageous pressure relief valve for a fuel injection pump, requires only limited control power because of the utilization of the fuel pressure conditions. The invention also offers considerable freedom with regard to the timing of the fuel injection cycle during the forward stroke of the fuel pump and operates at a high speed.

Although the invention has been described herein with reference to specific embodiments, many modifications and variations therein will readily occur to those skilled in the art. Accordingly, all such variations and modifications are included within the intended scope of the invention.

I claim:

1. A pressure relief valve for a fuel injection pump of an internal combustion engine comprising a valve body having a pressure chamber, a pressure relief outlet and a valve seat, a valve-closing element having a first end with an axial channel, a stop and at least one cross-channel, and a second end, an electrical actuation device at the second end of the valve-closing element capable of positioning the valve-closing element between a closed position and an open position, a sleeve-shaped servo slide gate surrounding the valve-closing element, and spring means acting on the servo slide gate to urge the servo slide gate toward the stop of the valve-closing element and to urge the valve-closing element toward the valve seat to close a pressure relief connection between the pressure chamber and the pressure relief outlet, wherein the valve-closing element, when positioned in the closed position, is not exposed to any axial pressure from the pressure chamber, whereas when the valve-closing element is in the open position, a connection is provided between the pressure chamber and the pressure relief outlet and, in response to a minimum amount of pressure in the pressure chamber, the servo slide gate moves away from the stop and exposes the cross-channel in the valve-closing element to form an additional pressure relief connection between the pressure relief outlet and the pressure chamber.

2. A pressure relief valve according to claim 1 wherein the pressure relief outlet extends coaxially with respect to the valve-closing element and to the outlet of the axial channel, and is enclosed concentrically by the valve seats.

3. A pressure relief valve according to claim 2 wherein the valve seat for the valve-closing element is enclosed by an additional valve seat coordinated with the servo slide gate, the additional valve seat being arranged so that the servo slide gate, in engagement with its valve seat, has essentially no surface area exposed axially to the pressure from the pressure chamber.

4. A pressure relief valve according to any of claims 1, 2 or 3, including a spring chamber which is connected with the axial channel for the removal of fuel by at least one cross-channel in the valve-closing element.

* * * * *